US006076571A

United States Patent [19]

Burns et al.

[11] Patent Number: 6,076,571

[45] Date of Patent: Jun. 20, 2000

[54] PASSTHROUGH ASSEMBLIES FOR A CHEMICAL PROTECTIVE SUIT

[76] Inventors: Keith Douglas Burns, 126 Victor Dr., Thurmont, Md. 21788; Louis Michael Riccio, 7 Rock Run La., Malvern, Pa. 19355; Edward Alan Culpepper, 1824 Metzerott Rd., #407, Adelphi, Md. 20783

[21] Appl. No.: 09/238,214

[22] Filed: Jan. 27, 1999

Related U.S. Application Data

[60] Provisional application No. 60/072,765, Jan. 27, 1998.

[51] Int. Cl.[7] ..... B65B 1/04

[52] U.S. Cl. ..... 141/383; 141/311 R; 141/384; 285/206

[58] Field of Search ..... 141/311 R, 383, 141/384; 285/124.2, 124.3, 124.4, 179, 206, 316; 128/201.24, 201.26, 201.28, 201.29, 202.11, 202.15, 202.19, 202.27; 2/2, 2.11, 2.14, 2.15

[56] References Cited

U.S. PATENT DOCUMENTS

| | | |
|---|---|---|
| 3,292,179 | 12/1966 | Iacono, Jr. et al. . |
| 3,345,641 | 10/1967 | Jennings . |
| 3,394,260 | 7/1968 | Phipps . |
| 3,457,918 | 7/1969 | Dibelius et al. . |
| 3,529,594 | 9/1970 | Charnley . |
| 3,625,206 | 12/1971 | Charnley . |
| 3,744,055 | 7/1973 | Brendgord . |
| 3,746,348 | 7/1973 | Stone . |
| 3,777,750 | 12/1973 | Savornin . |
| 3,831,954 | 8/1974 | Longfellow . |
| 4,090,029 | 5/1978 | Lundeberg . |
| 4,252,332 | 2/1981 | Nakayama et al. . |
| 4,458,466 | 7/1984 | Childers et al. . |
| 4,558,466 | 12/1985 | Kristensson . |
| 4,671,546 | 6/1987 | Arav . |
| 4,831,664 | 5/1989 | Suda . |
| 4,901,370 | 2/1990 | Suda . |
| 5,118,141 | 6/1992 | Miyashita . |
| 5,127,896 | 7/1992 | de Gaston . |
| 5,392,610 | 2/1995 | Nelson et al. ..... 62/77 |
| 5,516,122 | 5/1996 | Caffee . |
| 5,548,842 | 8/1996 | Wiseman, Sr. . |

OTHER PUBLICATIONS

Mine Safety Appliances Company; Chempruf II Total Encapsulating Suit Instruction Manual; published by Mine Safety Appliances Company, Pittsburgh PA, date unknown, 47 pp.

Mine Safety Appliances Company; Chempruf II Betex/Vautex Total Encapsulating Suits: Data Sheet 13–02–07; published by Mine Safety Appliances Company, Pittsburgh PA, 1993, 8 pp.

*Primary Examiner*—Steven O. Douglas
*Assistant Examiner*—Timothy L. Maust
*Attorney, Agent, or Firm*—Law Offices of Royal W. Craig

[57] ABSTRACT

An improved design for sealed air and coolant passthrough couplings which ensures maximum protection against contamination in a chemical warfare environment. The couplings include an air line bulkhead assembly, a liquid passthrough coupling, and an air inlet assembly all of which resist penetrating chemical warfare agents such as Sarin. The air line bulkhead assembly permits breathable air to be passed from outside to the inside of a chemical protective suit without compromising the chemical integrity of the suit. The liquid coolant passthrough permits liquid coolant to be supplied from an external source to the wearer of the chemical protective suit without breaching the integrity of the chemical protective barrier. The liquid coolant passthrough assembly enables a cold reservoir and pumping unit to be mounted on the exterior of chemical protective clothing to facilitate replenishment of the cold source (ice or phase change material), and this can result in longer mission stay times. Finally, the chemical resistant air inlet assembly may be used in conjunction with a self-contained breathing apparatus (SCBA) or air-supplied system to provide air to the chemical protective suit for purposes of generating a positive pressure therein. The air line bulkhead, air line passthrough assembly (incorporating the same), liquid passthrough coupling, and air inlet assembly as described above are simple yet innovative in design and lend themselves to economical manufacture and assembly.

11 Claims, 7 Drawing Sheets

PASSTHROUGH ASSEMBLIES FOR A CHEMICAL PROTECTIVE SUIT

CROSS-REFERENCE TO RELATED APPLICATIONS

The present application is based on Provisional Application No. 60/072,765 for "PASSTHROUGH ASSEMBLIES FOR A CHEMICAL PROTECTIVE SUIT", filed Jan. 27, 1998.

STATEMENT OF GOVERNMENT INTEREST

The invention was supported by the government under contract DAAK60-95-C-2013 awarded by United States Army Soldier Systems Command. The government has certain rights in this invention.

BACKGROUND OF THE INVENTION

1. Field of the invention

The present invention relates to protective clothing for use in a toxic environment and, more particularly, to an improved passthrough coupling design for supplying air and/or liquid to the suit in a chemical warfare agent environment.

2. Description of the Background

Chemical protective suits are used by emergency personnel to protect them against an array of toxic chemicals. These chemicals include blistering agents such as lewisite or mustard gas, choking agents such as phosgene (or CG as designated by the military), blood agents including cyanide based compounds such as hydrogen cyanide (AC), and nerve agents such as sarin, tabun, soman, and others.

The nerve agents are the most useful to terrorists because of the small quantity needed to inflict a substantial amount of damage. VX and sarin are the most toxic of the nerve agents and these can be synthesized by any competent chemist using limited laboratory facilities. For example, on Mar. 20, 1995, there was a terrorist sarin gas attack on the Tokyo subway that killed nearly a dozen people and injured approximately 5000 others. The incident involved six devices all set to go off on five different subway cars. A variety of protective suits have been developed to protect wearers against the adverse effects of these chemicals as well as biological, nuclear and other environmental contaminants or conditions. The design aspects of these highly specialized suits depend largely upon their specific applications. However, if just trace amounts of these toxic vapors penetrate the chemical protective suit the result can be severe injury or death. Consequently, most all of such suits employ an external pressurized air source for introducing pressurized clean filtered breathable air into the garment.

For example, U.S. Pat. No. 5,127,896 to de Gaston discloses an integrated anthromorphic suit with a breathing regulator for protecting the user of the suit from hostile environments. It also discloses an air hose 38 for delivering pressurized air to the user.

U.S. Pat. No. 4,558,466 to Kristensson discloses a vest for use in polluted atmosphere and a means for delivering fresh air to the user and knobs to control the temperature and heat of the delivered air.

U.S. Pat. No. 4,458,680 to Childers, et al discloses a protective supplied breathing air garment. An air supply line 23 provides a flow of breathing air to the user. Air supply line 23 is provided with a threaded female collar 25 for attaching to a retaining nipple 24 externally provided on the suit to provide an air-tight seal between the suit and the air supply line.

U.S. Pat. No. 3,777,750 to Savornin discloses a protective garment for conducting work in a deleterious atmosphere.

U.S. Pat. No. 3,457,918 to Dibelius et al. discloses a protective suit coupled with an air supply source for maintaining a viable atmoshpere inside the suit.

U.S. Pat. No. 3,394,260 to Phipps discloses a protective suit with a means of supplying fresh air to the protective suit 10 using a blower 38 through a tube 40.

U.S. Pat. No. 3,345,641 to Jennings discloses a ventilated space suit. The space suit 10 is provided with a portable life support system 20 which comprises an oxygen reservoir 22 connected to one end of supply line 28. The other end of supply line 28 is to the space suit 10 which also has an exhaust line 30 for removing the waste $CO_2$.

U.S. Pat. No. 3,292,179 to Iacono discloses a protective garment with a mechanism for circulating air. Air is introduced into the garment 10 through inlet ports 30 which communicate with the inner passageway 25. The exhaust air exits from the port 31 through the outer air passageway 26.

U.S. Pat. No. 4,458,680 to Edward L. Childers et al. shows one exemplary closed circuit system in which air is recirculated.

In some cases, chemical warfare suits may also employ liquid cooling systems that circulate liquid coolant from an external source. Whether air, water, or other fluid, the fluid must be pumped into the suit or expelled therefrom through tubes which are connected at suit couplings, i.e., "passthrough" assemblies. These passthrough assemblies must safeguard the integrity of the suit, especially in the chemical warfare context which often requires a hermetic seal. In such cases the couplings must be of the highest integrity and provide maximum protection against contamination. The designer must be cognizant of the fact that many chemical warfare agents are specifically intended for maximum penetration at seams and couplings.

There have been previous efforts to improve the integrity of air and liquid couplings or "passthroughs".

For instance, U.S. Pat. No. 5,516,122 to Caffee discloses a ultra-high vacuum elastomer O-ring seal. The surface of the O-ring seal conforms to the contours of the mating grooves on the surface of the metal flanges as the flange joint is tightened. This causes an increase in the area of contact between the O-ring and the mating surfaces and thus provides for an efficient sealing mechanism. Additionally, U.S. Pat. No. 5,118,141 to Miyashita discloses a union joint for hermetically connecting pipes; U.S. Pat. No. 4,671,546 to Arav discloses a device for sealing a bolt hole in a fluid containing assembly; U.S. Pat. No. 4,252,332 to Nakayama et al. discloses a sealing device for use in a swash-plate type compressor; U.S. Pat. No. 4,090,029 to Lundeberg discloses a conductive O-ring 18 that provides a tight seal and metal-to-metal contact; U.S. Pat. No. 3,831,954 to Longfellow discloses an improved gasket joint connection; and U.S. Pat. No. 3,746,348 to Stone discloses an O-ring with cylindrical nubs along its circumference to facilitate efficient sealing of flange type fittings.

While these and other couplings may have value in specific applications, they are unable to provide maximum protection against contamination in a chemical warfare environment. Certain chemical warfare agents such as Sarin (GB, a nerve agent) are capable of penetrating into the suit through the couplings. Thus, it would be a great advantage to provide an improved design for both air and liquid passthrough couplings to ensure maximum protection against contamination, especially in a chemical warfare environment where penetrating chemical warfare agents such as Sarin may be present.

SUMMARY OF THE INVENTION

It is, therefore, an object of the present invention to provide an improved design for air and water passthrough couplings which ensures maximum protection against contamination in a chemical warfare environment.

It is a more focussed object of the present invention to provide an improved airline passthrough coupling, liquid passthrough coupling, and air inlet assembly, all of which resist penetrating chemical warfare agents such as Sarin.

It is a further object to provide an array of couplings as described above for attachment of air and water lines at a bulkhead.

It is still another object to provide an air line passthrough coupling, liquid passthrough coupling, and air inlet assembly as described above which are simple yet innovative in design and which lend themselves to economical manufacture and assembly.

According to the present invention, the above-described and other objects are accomplished by providing a general design for a sealed coupling which is embodied in various air and/or liquid passthroughs or inlets for introducing or expelling air and water to/from a chemical protective suit.

One embodiment comprises an air line bulkhead assembly which is designed for installation in suit fabric. The bulkhead assembly includes bulkhead fitting, O-ring, passthrough plate with O-ring seat, outer gasket, inner gasket, washer and hex nut.

An outside seal is formed by the outer gasket and o-ring at the juncture of the bulkhead and passthrough plate and at the junction of the passthrough plate and suit fabric. The O-ring, passthrough plate, and outer gasket are sandwiched there between, and these preserve the hermetic seal. The passthrough plate is defined by a central aperture which, on one side, is bounded by an annular channel for seating the O-ring. This prevents the axial deformation of the O-ring when the airline passthrough assembly is tightened.

An application of the above described invention adds additional conventional fittings to the bulkhead assembly to accommodate standard air supply hoses.

In addition, a liquid coolant passthrough assembly is disclosed in accordance with another embodiment of the present invention (again designed for attachment at a reinforced area of the suit). The liquid coolant passthrough assembly permits liquid coolant to be supplied from an external source to the wearer of the chemical protective suit without breaching the integrity of the chemical protective barrier. The liquid coolant passthrough assembly enables a cold reservoir and pumping unit to be mounted on the exterior of chemical protective clothing to facilitate replenishment of the cold source (ice or phase change material), and this can result in longer mission stay times.

Finally, a chemical resistant air inlet assembly is disclosed in accordance with yet another embodiment of the present invention, and this is likewise designed for attachment at a reinforced area of the suit. The chemical resistant air inlet assembly is intended to be used in conjunction with an air supplied system (i.e., SCBA or tethered air line) to provide air to the chemical protective suit for purposes of generating a positive pressure within the suit. The chemical resistant air inlet assembly will typically be used with OSHA level B chemical protective suits in which the breathing apparatus is worn on the outside of the suit. The air inlet assembly serves as a chemical resistant passthrough to provide air at a flow rate of approximately 2–5 liters per minute (1 pm) from the externally worn SCBA or tethered air line to the inside of the suit. However, it should be noted that the air flow rates into the suit can be varied by changing a flow orifice (to be described).

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
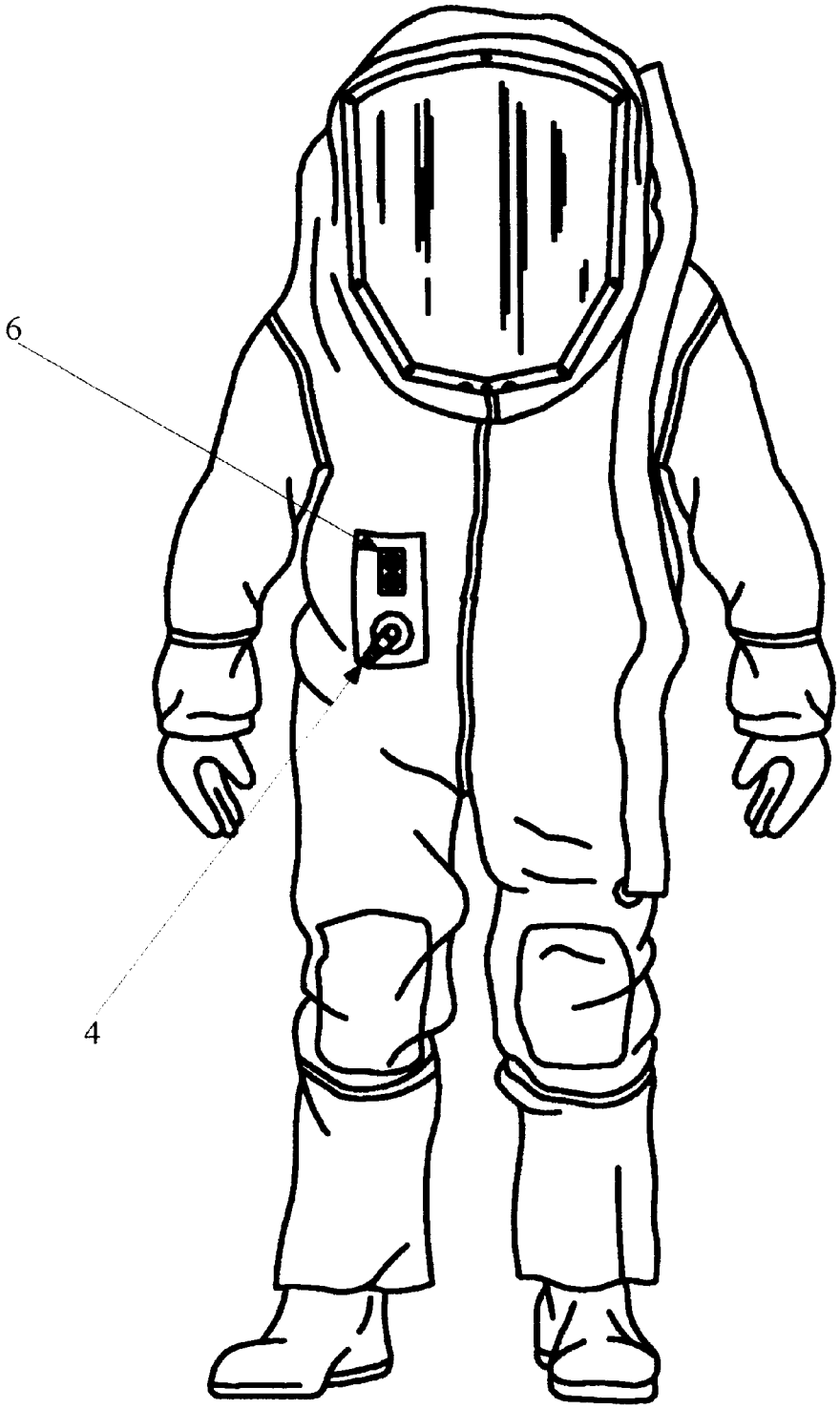
FIG. 1 is a perspective drawing of a suit 2 for the protection of a wearer against the adverse effects of chemical, biological, nuclear and like environmental contamination. Suit 2 incorporates both an air line passthrough assembly 4 according to one embodiment of the present invention, and a liquid coolant passthrough assembly 6 according to another embodiment of the present invention.

FIG. 1 is a perspective drawing of a suit 2 for the protection of a wearer against the adverse effects of chemical, biological, nuclear and other environmental contamination. The illustrated suit 2 is of the type which employs an external air source for introducing pressurized clean filtered breathable air into the garment. The air is input via a conventional air hose (not shown), and the air hose is connected through one or more couplings through the fabric of the suit. In a similar manner, some suits employ liquid cooling systems that circulate liquid coolant from an external source. Whether air, water, or other fluid, the fluid must be pumped into the suit or expelled therefrom through suit couplings. As stated above, the integrity of the couplings must be absolute. The present invention is an improved design which lends itself to both air and liquid passthrough couplings. In both applications the design ensures maximum protection against contamination, especially in a chemical warfare environment where penetrating chemical warfare agents such as Sarin may be present. In general terms, the heightened protection is achieved by imposing a double high-integrity seal at the coupling on both the outside and inside of the chemical warfare suit 2.

Figure 2:
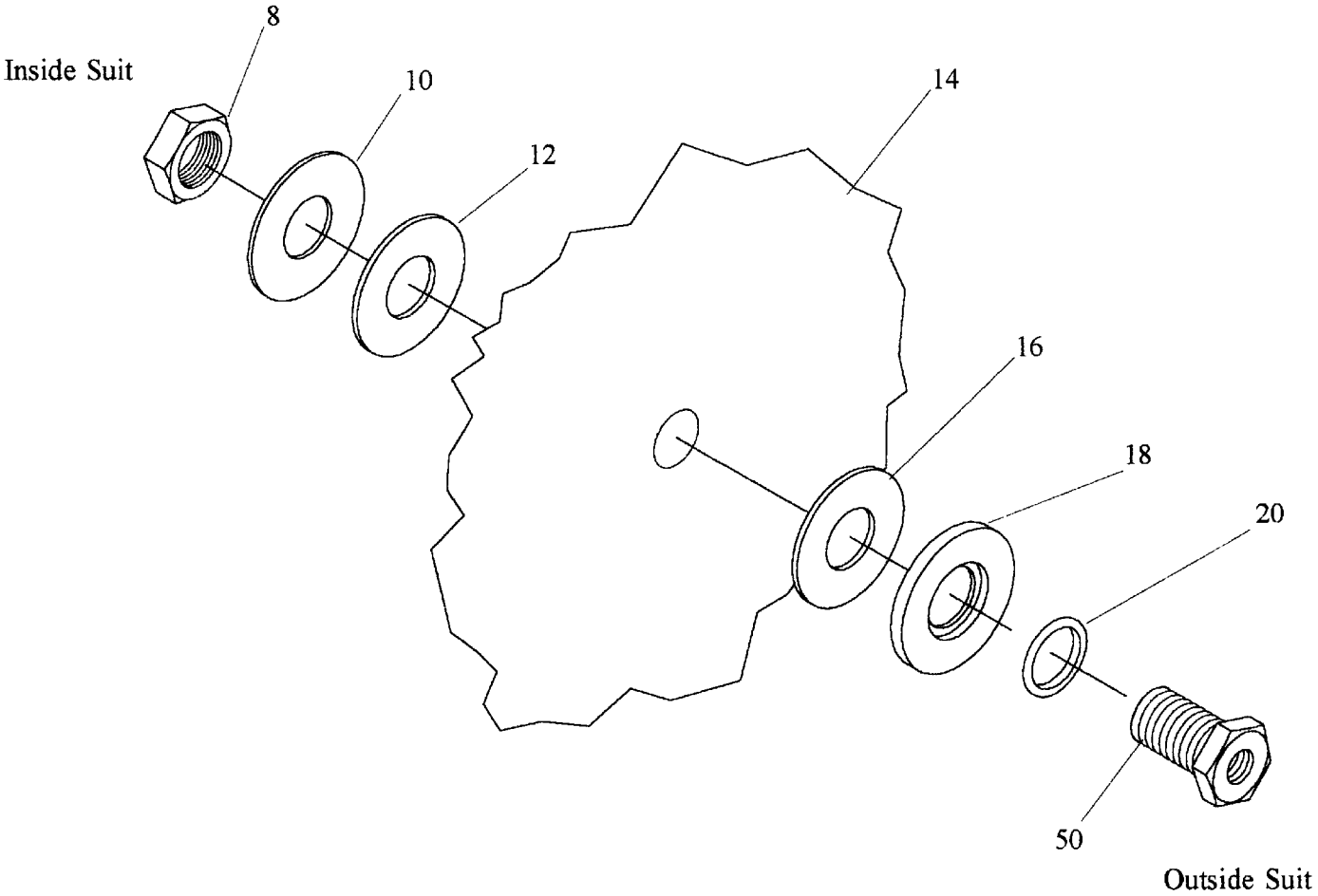
FIG. 2 is an exploded view perspective of an air line bulkhead assembly 5 according to the present invention.

FIG. 2 is an exploded perspective view of an exemplary air line bulkhead assembly 5 that incorporates the basic coupling design of the present invention. The air line bulkhead assembly 5 includes a bulkhead fitting 50, O-ring 20, passthrough plate 18 with O-ring seat, outer gasket 16, inner gasket 12, washer 10 and hex nut 8. The bulkhead assembly 5 may be used with a variety of other fittings (as will be described) to provide a means for supplying air to the user of a totally encapsulating chemical protective suit without breaching the chemical integrity of the suit.

The bulkhead fitting 50 is installed through the suit fabric 14 preferably at a location which is reinforced with additional layers of fabric. On the outside of the suit, the bulkhead fitting 50 is passed through the O-ring 20, passthrough plate 18 with O-ring seat, outer gasket 16, and the suit fabric 14. On the inside of the suit, the bulkhead fitting 50 is passed through inner gasket 12 and washer 10. The hex nut 8 is threaded onto the bulkhead fitting 50 and is tightened to make the seal at the O-ring 20, outer gasket 16 and inner gasket 10. The outer seal is formed in two places: (1) by the O-ring at the junction of the bulkhead fitting 50 and passthrough plate 18 with O-ring seat; and (2) by the outer gasket 16 at the junction of the passthrough plate 18 with O-ring seat and suit fabric 14. An inner seal is formed by the inner gasket 12 at the junction of the suit fabric 14 and the washer 10.

The bulkhead fitting 50 has a central through-hole and is tapped from both ends with ¼-inch female pipe thread. The bulkhead assembly 5 serves as the passage way for breathing grade air to get from the outside of the suit fabric 14 to the inside of the suit fabric 14. The ¼-inch pipe thread permits a wide variety of pipe fittings to be connected to the bulkhead fitting 50 (e.g., see FIG. 5 and accompanying description) such that the breathing air can be supplied through a conventional air supply hose (not shown).

The shaft of the bulkhead fitting 50 is threaded with ¾-16UNF2A thread to accept the hex nut 8 which, when tightened, secures the bulkhead fitting 50 in the suit 14.

Figure 3:
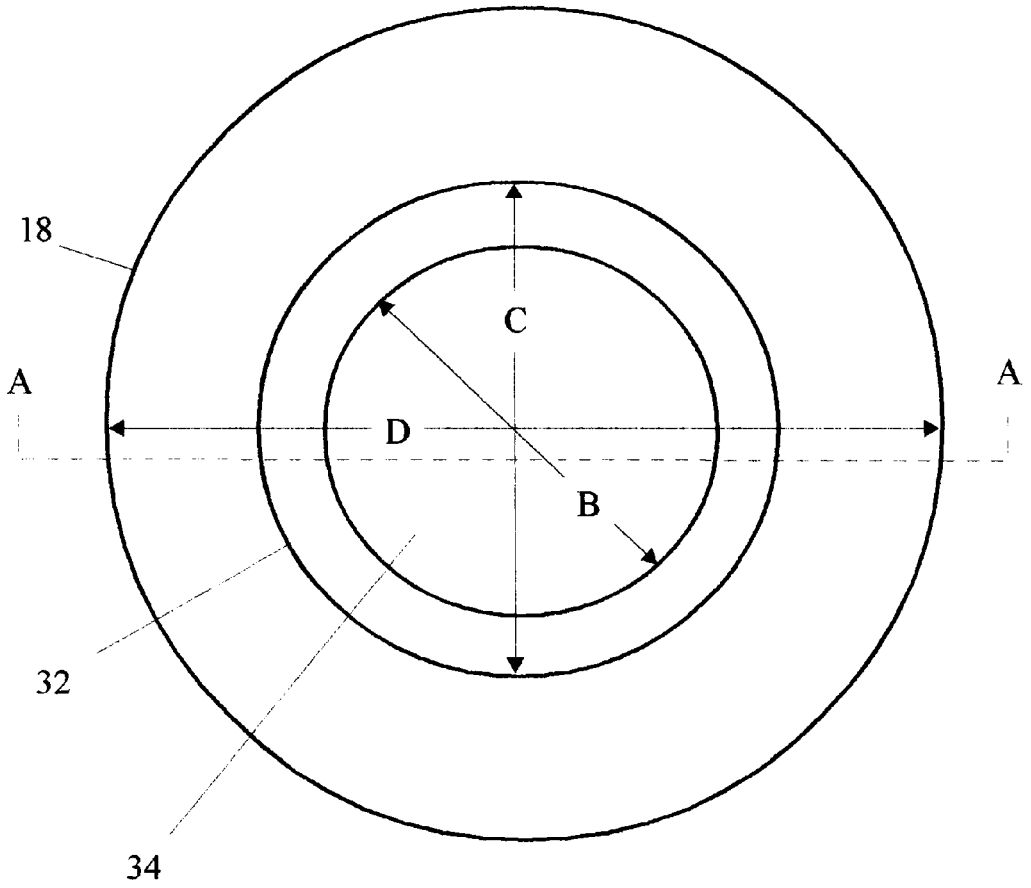
FIGS. 3 and 4 are a front view and side view, respectively, of the passthrough plate 18 with O-ring seat used in the bulkhead assembly 5 of FIG. 2.
Figure 4:
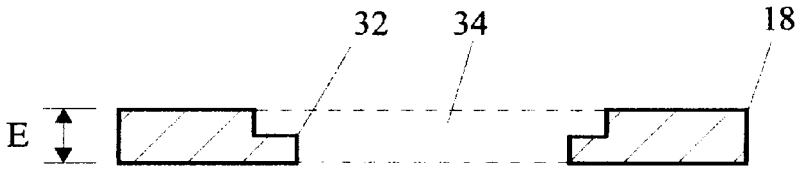

FIGS. 3 and 4 are a front view and side view, respectively, of the passthrough plate 18 with O-ring seat as used in the air line bulkhead assembly 50 of FIG. 2. The passthrough plate 18 is defined by a central aperture 34 which, on one side is bounded by an annular channel 32 for seating of the O-ring. The thickness of the passthrough plate 18 as shown by reference E is approximately 0.156 inches. The diameter of the passthrough plate 18 as shown by reference D is approximately 1.75 inches. The diameter of the central aperture 34 as shown by reference B is approximately 0.757 inches. The diameter to the periphery of the channel 32 as indicated at C is approximately 1.0 inch, and channel 32 is approximately 0.09 inches deep. The channel 32 in the passthrough plate prevents the axial deformation of the O-ring 20 when the hex nut 8 is tightened on the bulkhead fitting 50.

The bulkhead fitting 50, hex nut 8, passthrough plate 18 with O-ring seat and washer 10 are preferably fabricated from stainless steel.

The inner and outer gaskets 12, 16 are elastomeric and are preferably approximately 1/16-inch thick.

The O-ring 20 is preferably elastomeric and has a ¾-inch inner diameter, 1-inch outer diameter, and ⅛-inch thickness.

The airline bulkhead assembly with passthrough plate 18 as shown in FIGS. 2–4 permits breathable air to be passed from outside to the inside of a chemical protective suit without compromising the chemical integrity of the suit. The above-described double hermetic outer seal formed by the outer gasket 12 and O-ring 20 ensures maximum protection against contamination, and tests have shown that there is no chemical agent penetration of Sarin (GB) or other agents.

The bulkhead assembly 5 design concepts described with regard to FIG. 2 may be readily adapted for the connection of an air hose to provide an airline passthrough coupling 4. For example, the suit 2 of FIG. 1 is of the type which employs an external air source for introducing pressurized clean filtered breathable air into the garment. The air is input via a conventional air hose (not shown), and the air hose is connected to an airline passthrough coupling 4. The airline passthrough coupling 4 incorporates the structural doble-seal of the present invention to insure maximum protection against contamination in a chemical warfare environment. FIG. 1 also shows a quick connect coupling 6 (to be described) that provides a means for the passthrough assembly 4 to be attached to an existing air respirator with a standard conventional hose (not shown).

Figure 5:
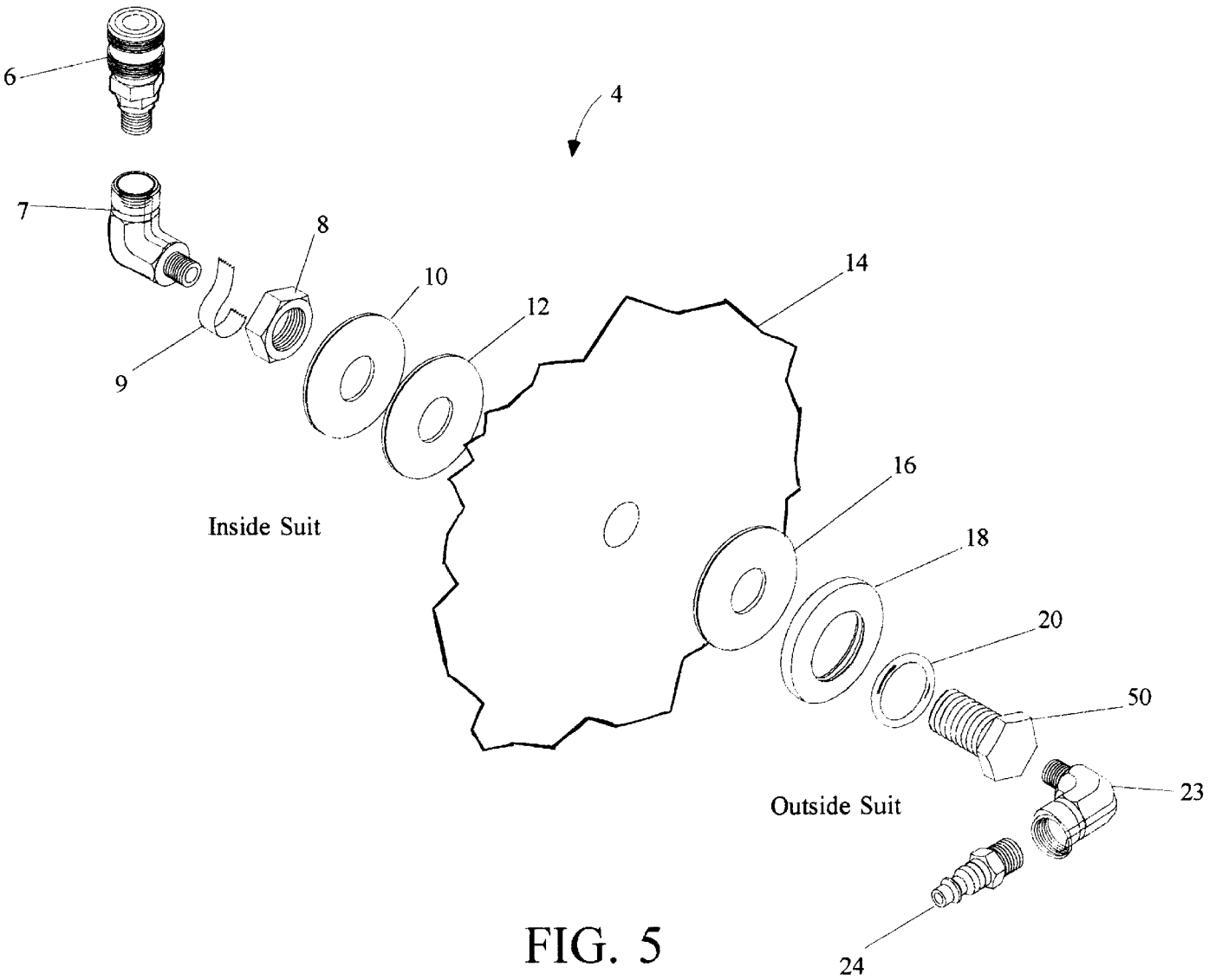
FIG. 5 is an exploded perspective view of an air line passthrough assembly 4 which incorporates the air line bulkhead assembly 5 of FIG. 2.

FIG. 5 is an exploded perspective view of an air line passthrough assembly suitable for use as the passthrough 4 of FIG. 1. Again, the bulkhead fitting 50 preferably passes through the suit fabric 14 at a location which is reinforced with additional layers of fabric. The passthrough assembly 4 begins with the basic bulkhead assembly described in FIG. 2, and like parts are similarly labeled. In addition, air line passthrough assembly 4 employs a quick connect coupling 6, 90 degree elbow 7, self sealing plug 24, and 90 degree elbow 23. The quick connect coupling 6 is worn on the inside of the suit 14 and provides a means for the passthrough assembly 4 to be attached to an existing air respirator with a standard conventional hose (not shown). The self-sealing plug 24 is worn on the outside of the suit 14 and provides a means for connecting a standard conventional air supply hose (not shown). Self-sealing plug 24 is threaded into a 90 degree elbow 23 which in turn is threaded into the bulkhead fitting 50. The bulkhead fitting 50 then passes through the O-ring 20, passthrough plate 18 with O-ring seat, outer gasket 16, suit fabric 14, inner gasket 12 and washer 10. The hex nut 8 is threaded onto the bulkhead fitting 50 and tightened to make the seal at the O-ring 20, outer gasket 16 and inner gasket 12. The outer seal is formed in two places: (1) by the O-ring 20 at the junction of the bulkhead fitting 50 and passthrough plate 18 with O-ring seat; and (2) by the outer gasket 12 at the junction of the passthrough plate 18 with O-ring seat and suit fabric 14. An inner seal is formed by the inner gasket 12 at the junction of the suit fabric 14 and the washer 10.

The quick connect coupling 6 is threaded into the inner 90 degree elbow 7 which is in-turn threaded into the bulkhead fitting 50. The inner 90 degree elbow 7 is not threaded into the bulkhead fitting 50 until the hex nut 8 has been securely tightened.

Fabrication of the quick connect coupling 6, 90 degree elbows 7, 23 and self-sealing plug 24 is preferably from stainless steel, and the use of Teflon based pipe joint compounds and conventional anti-seize tapes 9 maximizes the protection afforded by the passthrough assembly 4 and maximizes the useful life of the components. Suitable 90 degree elbows 7, 23 are available from the Parker Hannifin Corp. as part no. ¼-CD-SS 90 degree street elbow. A suitable commercial quick connect coupling 6 is available from the Hansen Co. as part no. LL-1100. A suitable commercial self-sealing plug 24 is available from the Hansen Co. as part no. LL-10. Hex nut 8 may be a conventional stainless ¾—16 UNF-2B hex nut.

As stated previously, some chemical warfare suits also employ liquid cooling systems that circulate liquid coolant from an external source. Like air, the liquid must be pumped into the suit or expelled therefrom through inlet and outlet tubes which are connected at liquid passthrough assemblies.

Figure 6:
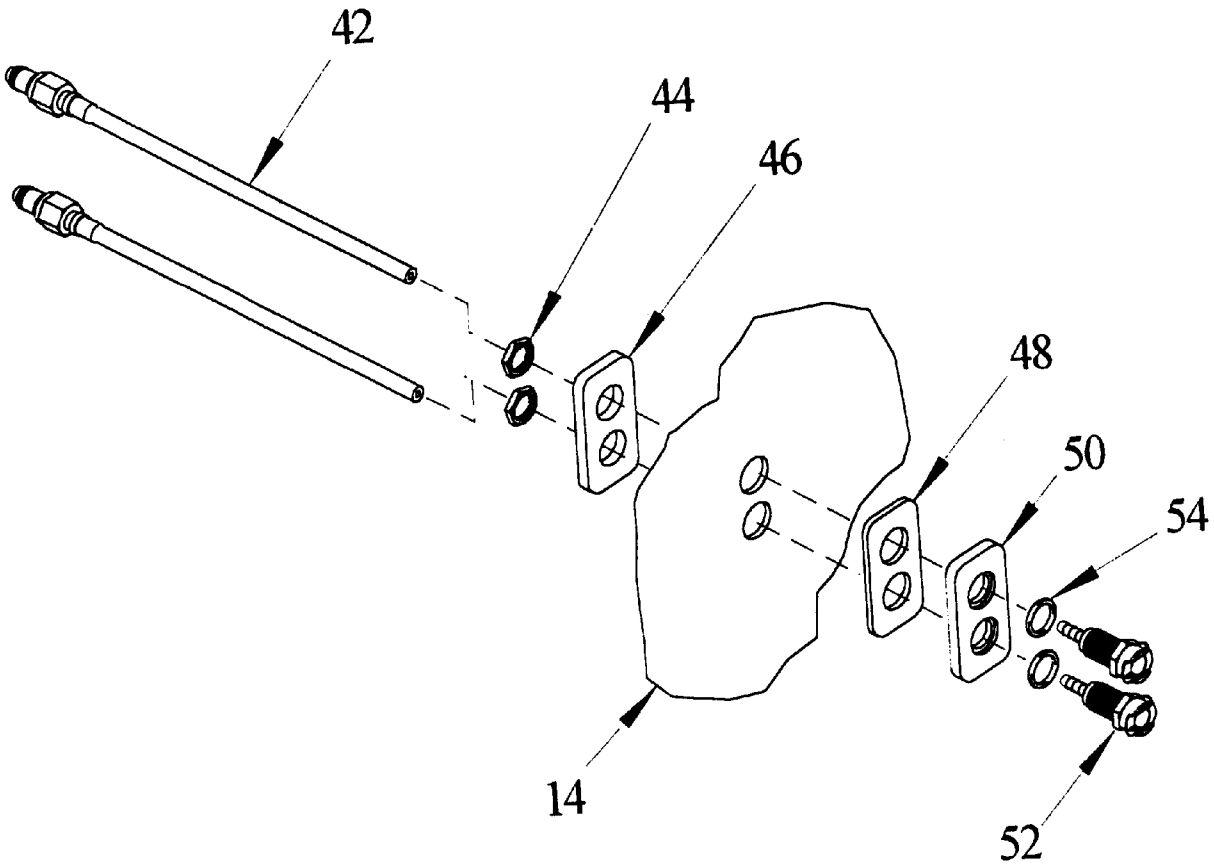
FIG. 6 illustrates a liquid coolant passthrough assembly 6 according to another embodiment of the present invention which is designed for attachment at a reinforced area of soft fabric.

FIG. 6 illustrates a liquid coolant passthrough assembly 6 according to another embodiment of the present invention which is designed for attachment at a reinforced area of suit fabric 14. The liquid coolant passthrough assembly 6 permits liquid coolant to be supplied from an external source to the wearer of the chemical protective suit without breaching the integrity of the chemical protective barrier. The liquid coolant passthrough assembly 6 enables the cold reservoir and pumping unit to be mounted on the exterior of chemical protective clothing to facilitate replenishment of the cold source (ice or phase change material), and this can result in longer mission stay times. The liquid passthrough 6 has two sets of couplings and tubing to accommodate inlet and outlet of the circulating coolant. Quick connect style couplings are used to simplify installation and use with the cooling garment and pumping unit (not shown). The liquid coolant passthrough assembly 6 generally comprises a pair of panel mount couplings 52, two elastomeric O-rings 54, a unitary elastomeric gasket 48, high density polyethylene (HDPE) inner and outer plates 46 and 53, respectively, and two in-line couplings 40 with vinyl tubing 42, cable ties 51 and hex nuts 44. The quick connect couplings 52 provide a quick-connect for attachment of two conventional coolant supply hoses (not shown). The inner ends of quick-connect couplings 52 may be standard self-sealing plugs. The self-sealing plugs of quick-connect couplings 52 are inserted through O-rings 54, a unitary passthrough plate 53, and a unitary outer gasket 48 and finally through a hole formed in the reinforced area 14 of the suit fabric. The outside seal is formed at this juncture of the passthrough plate 53 with suit fabric 14, and gasket 48 sandwiched therebetween. The seated O-rings 54 help to preserve the outside hermetic seal. The body of the panel mount couplings 52 penetrate the suit, and the vinyl tubing 42 attached directly to the barbs of the panel mount couplings 52. The panel mount couplings 52 are sealed on the outside of the suit by the passthrough plate 53, the gasket 48 and the O-rings 54. The O-rings 54 provide a seal between the couplings 52, and the outer plate 53 and the gasket 48 provides the seal between the outer plate 53 and the suit 14. The compression seal of the gasket 48 and O-rings 54 is achieved by tightening the hex nuts 44 to a specified torque value. As before, the outer plate 53 includes O-ring seats to provide a greater sealing surface for the O-rings 52 and to prevent distortion of the O-rings 52 when the hex nuts 44 are tightened. On the inside of the suit 14, the inner plate 46 serves as a semi-rigid surface to support the tightening of the hex nuts 44. The liquid coolant passthrough assembly 6 provides chemical protection for up to 4 hours against chemical agents.

Panel mount couplings 52 are preferably chrome-plated brass panel mount couplings for conventional coolant tubing. The two in-line couplings 40 are equipped with vinyl tubing 42 and cable ties 51.

Elastomeric O-rings 52 are preferably Buna-N O-rings having a ½" inside diameter, a ⅝" outside diameter, and a 1/16" width.

Hexagonal nuts 44 are preferably chrome-plated brass nuts.

Inner and outer passthrough plates 46, 53 are high-density polyethylene (HDPE) plates with dual apertures. The apertures of the outer passthrough plate 53 are both bounded by channels to prevent axial deformation of the O-rings 54 when the hex nuts 44 are tightened.

Gasket 48 is an elastomeric gasket with dimensions conforming to those of the outer passthrough plate 53 and adapted for insertion thereunder for a compression seal against fabric 14. Once again, the dual compression seal formed at the outside seal and inside seal is achieved by tightening the hex nuts 44 to a specified torque value. This ensures maximum protection against contamination in a chemical warfare environment, and the passthrough resists penetrating chemical warfare agents such as Sarin for at least four hours.

Figure 7:
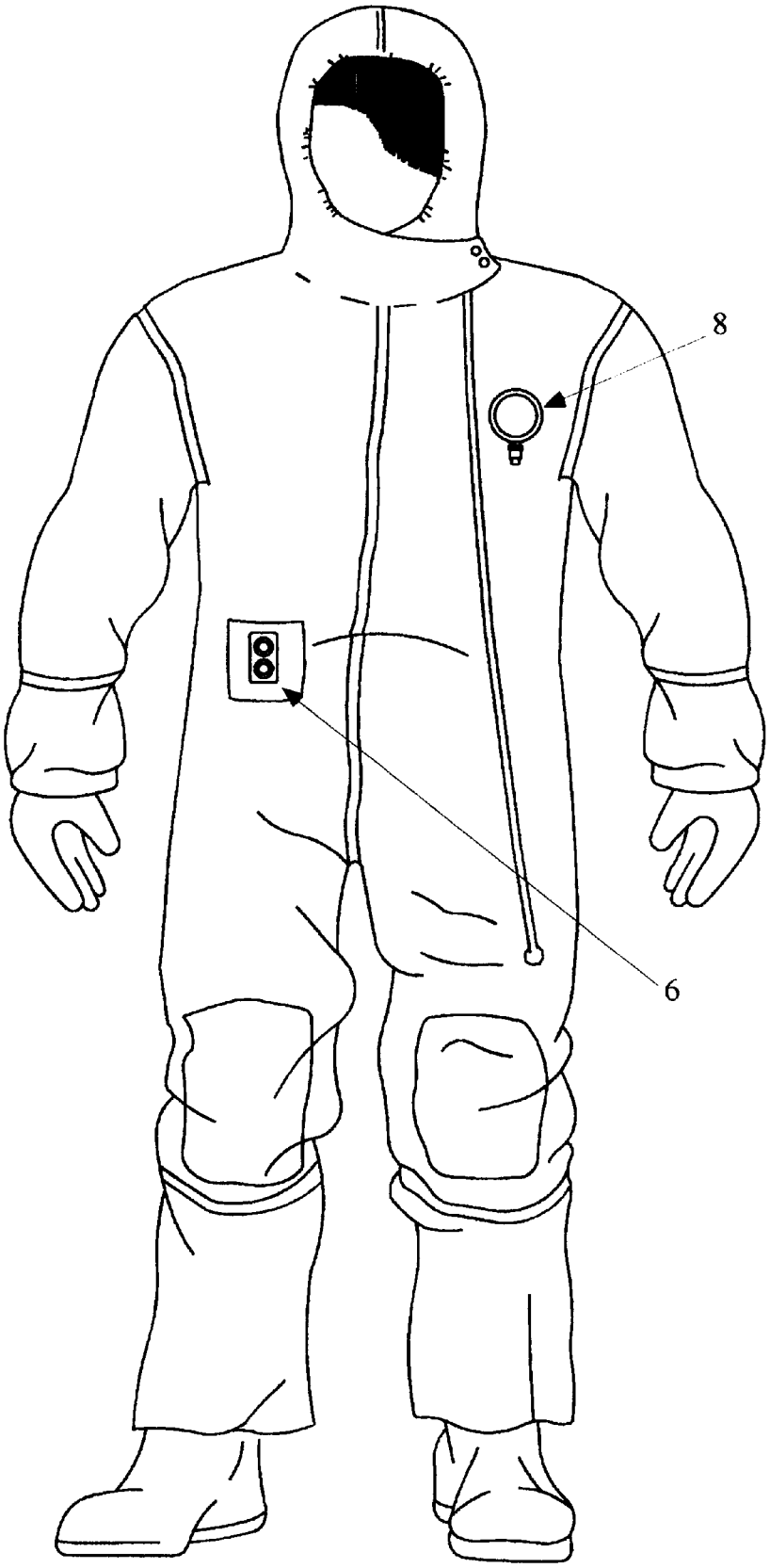
FIG. 7 is a perspective drawing of an OSHA level B type suit for the protection of a wearer against the adverse effects of chemical, biological, nuclear and other environmental contamination.

FIG. 7 is a perspective drawing of a suit for the protection of a wearer against the adverse effects of chemical, biological, nuclear and other environmental contamination. The illustrated suit is of the OSHA level B type in which the breathing apparatus is worn on the outside of the suit which employs an external air source for introducing pressurized clean filtered breathable air into the garment. The suit employs a liquid coolant passthrough assembly 6 as described above. In addition, a chemical resistant air inlet assembly 8 is provided in accordance with another embodiment of the present invention, and this is likewise designed for attachment at a bulkhead (reinforced area of fabric 14). The chemical resistant air inlet assembly 8 is intended to be used in conjunction with a self-contained breathing apparatus (SCBA) to provide air to the chemical protective suit for purposes of generating a positive pressure within the suit. The chemical resistant air inlet assembly 8 will typically be used with OSHA level B chemical protective suits in which the breathing apparatus is worn on the outside of the suit. The air inlet assembly 8 serves as a chemical resistant passthrough to provide air at a flow rate of approximately 2–5 liters per minute (1 pm) from the externally worn SCBA to the inside of the suit.

Figure 8:
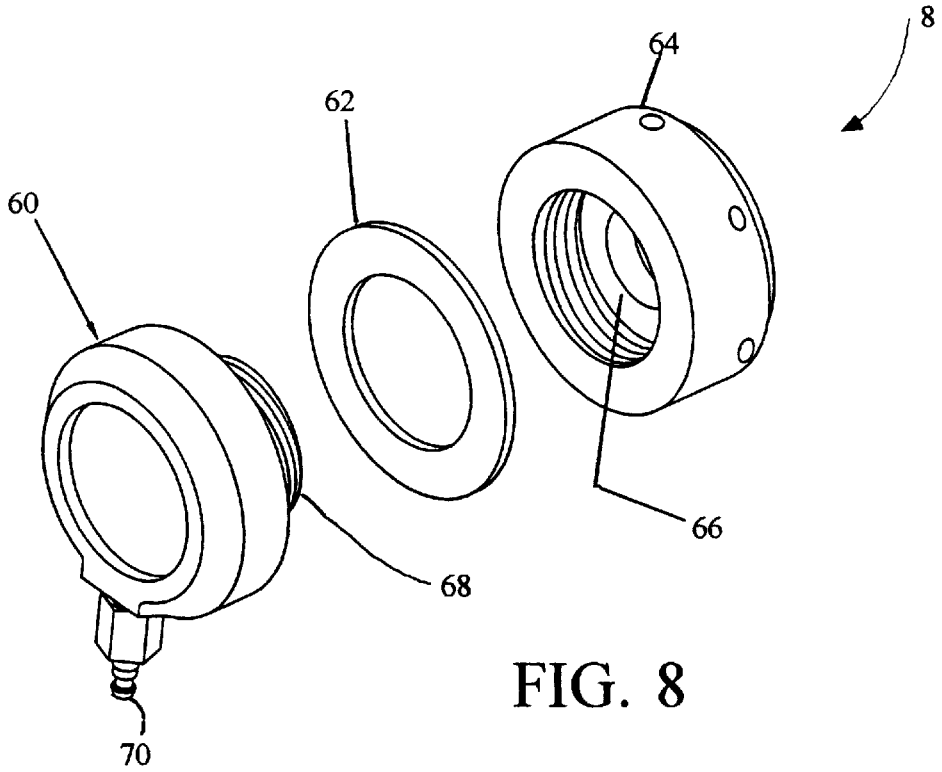
FIGS. 8 and 9 are front and rear exploded perspective views, respectively, of an air inlet assembly 8 according to another embodiment of the present invention.
Figure 9:
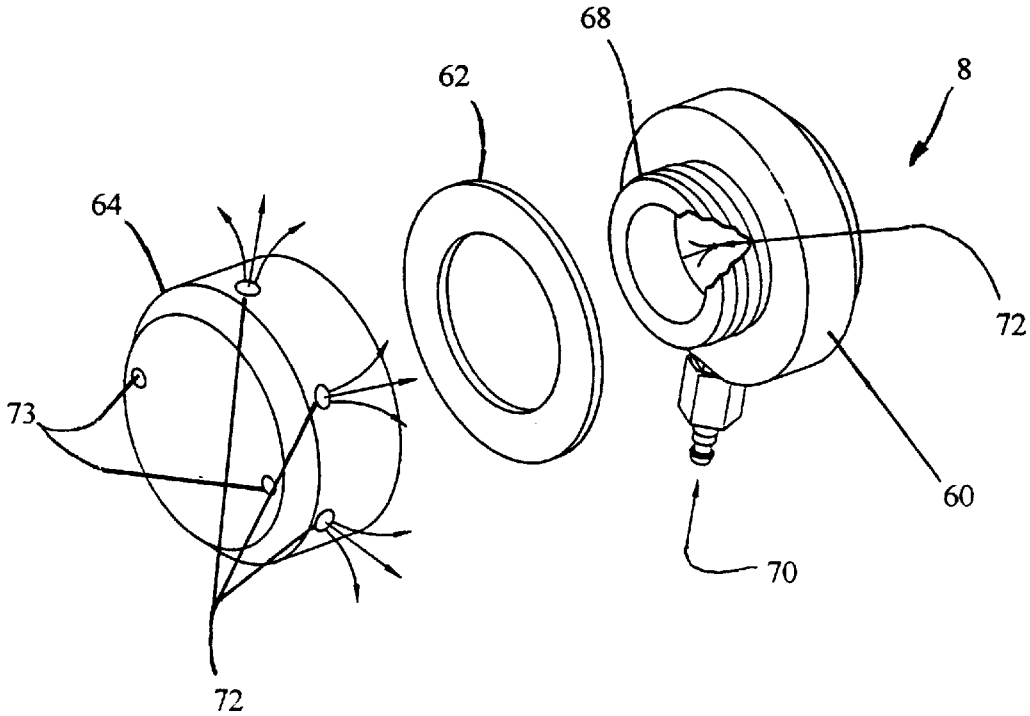

FIGS. 8 and 9 are front and rear exploded perspective views, respectively, of the air inlet assembly 8. Generally, the air inlet assembly 8 comprises an outer body assembly 60, an inner body 64, and an elastomeric gasket 62. The outer body 60 is formed with a vertical air passage leading upward to a flow orifice 72 from a self-sealing male coupling 70. The flow orifice 72 controls the air flow and emits a measured flow at a right angle into a threaded sleeve 68. The male coupling 70 serves as an interface for connection of a conventional SCBA air hose. When air is provided from the air supplied system at 100–110 psig, an air flow rate of approximately 2–51 pm will be provided through the flow orifice 72. However, it should be noted that the air flow rate into the suit can be varied as desired by changing the size of the flow orifice 72. The air from the flow orifice 72 is then directed through threaded sleeve 68 and through the suit material (not shown), where it is dispersed by the inner body assembly 64. The inner body assembly 64 disperses the air through air holes 72 to the inside of the suit. The threaded sleeve 68 of outer body 60 screws into interior threads in the inner body 64, and sockets 73 are provided for assembly/disassembly with a spanner wrench. Thus, to install the air inlet assembly 8, the inner and outer bodies 64, 60 are screwed together with the gasket seal 62 sandwiched there between on the outside of the suit. In addition to sockets 73, the inner body 64 may be provided with two lateral recesses to accommodate a wrench. Once again, the air inlet assembly 8 must be tightened to a specified torque value to achieve a proper chemical resistant seal.

Gasket 62 is a conventional elastomeric gasket.

The inner and outer body assemblies 64, 60 are both machined or otherwise formed from Delrin™ plastic and have mating NATO threads (i.e., 40 DIN). The self-sealing male coupling 70 is preferably a conventional chrome-plated brass coupling for attachment of a conventional air hose.

As before, the compressive seal formed at the outside of the bulkhead ensures maximum protection against contamination in a chemical warfare environment, and the air inlet assembly resists penetrating chemical warfare agents such as Sarin.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A fluid coupling for supplying fluid to the wearer of a chemical protective suit without breaching the chemical integrity of the suit, comprising:

an outer gasket adapted to abut the fabric of the chemical protective suit for forming a seal thereagainst;

a passthrough plate abutting said outer gasket, said passthrough plate having an aperture therethrough and a channel surrounding said aperture for providing an O-ring seat;

an O-ring seated in the channel of said passthrough plate;

a bulkhead fitting including a flange and a threaded sleeve for insertion through the outer gasket, passthrough plate, O-ring, and fabric of the chemical protective suit;

an elastomeric inner gasket adapted to abut the fabric of the chemical protective suit for forming a seal thereagainst;

a washer abutting said elastomeric inner gasket, said washer having an aperture therethrough; and a hex nut for screw-insertion on the threaded sleeve of said bulkhead fitting.

2. The fluid coupling for supplying fluid to the wearer of a chemical protective suit according to claim 1, wherein said passthrough plate channel further comprises an annular recess of slightly lesser depth than the diameter of the O-ring for seating said O-ring and preventing axial deformation.

3. The fluid coupling for supplying fluid to the wearer of a chemical protective suit according to claim 2, wherein said bulkhead fitting, hex nut, passthrough plate and washer are fabricated from stainless steel.

4. The fluid coupling for supplying fluid to the wearer of a chemical protective suit according to claim 3, wherein said inner and outer gaskets are elastomeric.

5. The fluid coupling for supplying fluid to the wearer of a chemical protective suit according to claim 4, wherein said O-ring is elastomeric.

6. The fluid coupling for supplying fluid to the wearer of a chemical protective suit according to claim 1, wherein a first hermetic seal is formed by the elastomeric outer gasket sandwiched between the fabric of the chemical protective suit and the passthrough plate, and a second hermetic seal is formed by the O-ring seated in the passthrough plate and sandwiched therein by the flange of said bulkhead fitting.

7. The fluid coupling for supplying fluid to the wearer of a chemical protective suit according to claim 6, wherein a third hermetic seal is formed by the elastomeric inner gasket sandwiched between the fabric of the chemical protective suit and the washer and hex nut threaded on the sleeve of said bulkhead fitting.

8. The fluid coupling for supplying fluid to the wearer of a chemical protective suit according to claim 1, further comprising a quick connect coupling attached to said bulkhead fitting.

9. The fluid coupling for supplying fluid to the wearer of a chemical protective suit according to claim 2, further comprising an elbow fitting attached to said bulkhead fitting, and a quick connect coupling attached to said elbow.

10. The fluid coupling for supplying fluid to the wearer of a chemical protective suit according to claim 1, further comprising a quick connect plug attached to said bulkhead fitting.

11. The fluid coupling for supplying fluid to the wearer of a chemical protective suit according to claim 1, further comprising an elbow fitting attached to said bulkhead fitting, and a quick connect plug attached to said elbow.

* * * * *